US008974028B2

(12) United States Patent
Ogawa

(10) Patent No.: US 8,974,028 B2
(45) Date of Patent: Mar. 10, 2015

(54) METHOD OF FORMING INK EJECTION ADJUSTMENT PATTERN, INK EJECTION ADJUSTMENT METHOD FOR INKJET HEAD AND INKJET PRINTER

(71) Applicant: Masanobu Ogawa, Aichi (JP)

(72) Inventor: Masanobu Ogawa, Aichi (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 0 days.

(21) Appl. No.: 13/853,289

(22) Filed: Mar. 29, 2013

(65) Prior Publication Data

US 2014/0009524 A1 Jan. 9, 2014

(30) Foreign Application Priority Data

Jul. 9, 2012 (JP) ..... 2012-153715
Jul. 9, 2012 (JP) ..... 2012-153716

(51) Int. Cl.

| | |
|---|---|
| ***B41J 29/38*** | (2006.01) |
| ***B41J 2/125*** | (2006.01) |
| ***B41J 2/07*** | (2006.01) |
| ***B41J 29/393*** | (2006.01) |
| ***B41J 2/21*** | (2006.01) |

(52) U.S. Cl.

CPC .. *B41J 2/125* (2013.01); *B41J 2/07* (2013.01); *B41J 29/393* (2013.01); *B41J 2/2135* (2013.01)

USPC ..... 347/12

(58) Field of Classification Search

CPC ..... B41J 29/38; B41J 2/07; B41J 2/2132; B41J 2/2117; B41J 2/2146

See application file for complete search history.

(56) References Cited

U.S. PATENT DOCUMENTS

| | | | |
|---|---|---|---|
| 5,353,052 | A | 10/1994 | Suzuki et al. |
| 5,552,810 | A | 9/1996 | Matsuo |
| 5,596,353 | A | 1/1997 | Takada et al. |
| 5,736,996 | A | 4/1998 | Takada et al. |
| 6,000,776 | A | 12/1999 | Suzuki et al. |
| 6,082,911 | A | 7/2000 | Murakami |
| 2009/0058895 | A1 | 3/2009 | Kida |

FOREIGN PATENT DOCUMENTS

| | | | |
|---|---|---|---|
| JP | Hei 4-18356 | A | 1/1992 |
| JP | Hei 4-18362 | A | 1/1992 |
| JP | 3117849 | | 10/2000 |
| JP | 2010-52286 | | 3/2010 |

OTHER PUBLICATIONS

Extended European Search Report dated Oct. 22, 2013 from related European Application No. 13 16 1411.7.

*Primary Examiner* — Lisa M Solomon

(74) *Attorney, Agent, or Firm* — Scully, Scott, Murphy & Presser, PC

(57) ABSTRACT

An ejection adjustment pattern forming method of forming an ejection adjustment pattern on a print medium with an inkjet head, which has a plurality of nozzles, with moving the inkjet head in a predetermined scanning direction. The method forms a plurality of thickness measurement patterns respectively on a plurality of pattern forming areas defined on the print medium by causing the plurality of nozzles of the inkjet head to eject ink drops, and forms a plurality of judging patterns respectively on the plurality of pattern forming areas. The ejection conditions of the plurality of nozzles, when the plurality of thickness measurement patterns are formed, are the same among the plurality of pattern forming areas. Further, the ejection conditions of the plurality of nozzles when the first judging pattern is formed and when the second judging pattern is formed are the same among the plurality of pattern forming areas.

8 Claims, 10 Drawing Sheets

METHOD OF FORMING INK EJECTION ADJUSTMENT PATTERN, INK EJECTION ADJUSTMENT METHOD FOR INKJET HEAD AND INKJET PRINTER

CROSS-REFERENCE TO RELATED APPLICATION

This application claims priority under 35 U.S.C. §119 from Japanese Patent Applications No. 2012-153715 and No. 2012-153716, both filed on Jul. 9, 2012. The entire subject matter of the application is incorporated herein by reference.

BACKGROUND

1. Technical Field

The present invention relates to a technique of adjusting ink ejection of nozzles of an inkjet head. Specifically, the invention relates to the technique of suppressing unevenness of ejection amount of ink due to uneven characteristics of ink ejection among a plurality of nozzles of the inkjet head.

2. Prior Art

Conventionally, in a field of an inkjet printer, it has been known that the unevenness of the thickness is observed on an image formed on a print sheet due to unevenness of the ink ejection characteristics among the nozzles of the inkjet head.

The unevenness of the ink ejection characteristics may include unevenness of resistance in ink flow paths connected to the nozzles due to respective shapes thereof, unevenness of characteristics of actuators applying ink ejection energies to the ink and the like. Because of such causes, among a plurality of nozzles, the ink ejection characteristics, for example, ink ejection amount from each nozzle, a speed of the ink ejected from each nozzle, are varied. When the ink ejection characteristics are varied among the plurality of nozzles, quality of the image is deteriorated since the thickness of the formed image appears to have unevenness as the size of the dots formed on the print sheet may be uneven, positions of the dots are displaced. In order to cope with such a problems, there has been know a technique to suppress the unevenness of the thickness of the image due to the unevenness of the ink ejection characteristics by adjusting an ink ejection condition for each of the plurality of nozzles.

There is known a technique of printing an image pattern to obtain information of the unevenness of image thickness, which information is necessary for compensating the unevenness of the ink ejection characteristics among the plurality of nozzles. Specifically, according to the above patent, four filled patters, which are the unevenness detection patters, are formed using the nozzles aligned in a line. Next, the four filled patterns are scanned using an image sensor, and obtain thicknesses of the portions formed by the respective nozzles. Then, based on thus obtained thickness data for each of the nozzles, a thickness compensation is performed for each nozzle when an image is formed on the print sheet. According to this technique, four pieces of thickness data corresponding to the four patterns are obtained, which may be averaged or the mode value may be used.

Incidentally, it is preferable that a gap between the inkjet head and the print head is a fixed and ideal one over an entire area of the print sheet. However, in practice, the print sheet may include rising portions, warpage portions and corrugated portions, and the gap may not be constant over the entire area of the print sheet.

Under such a condition, if the thickness measuring patters as disclosed in the above-described patent are formed, the thickness of the patters may be changed due to the unevenness of the gap. An example of such a problem will be described below.

SUMMARY OF THE INVENTION

As a recording method using the inkjet head, a one-directional print and a bi-directional print are known. In the mono-directional print, the ink is ejected only when the inkjet head is moved in one direction (along a scanning direction), while the ink is ejected when the inkjet head is moved in both directions.

When the bi-directional print is performed, if there is unevenness in the gap between the nozzles of the inkjet head and the print sheet, the spotter positions of the ink ejected in respective directions are displaced. As shown in FIG. 5, if the gap is smaller (i.e., Gb) and an ideal gap (Ga), a flying time of an ink drop ejected from a nozzle is relatively small. In such a case, the ink drops ejected in respective moving directions are spotted on positions B1 and B2 which are close to the ejected positions. In contrast, if the gap is larger (Gc) than the ideal gap (Ga), the flying time of an ink drop is relatively long, the ink drops are spotted on positions C1 and C2, which are farther from the ejected positions. Thus, the ink drops which are to be spotted on the ideal position A, are spotted on the positions B1 and B2 when the gap is small, while spotted on the positions C1 and C2 when the gap is relatively large. When the spotted positions are displaced as described above, there occurs unevenness between images formed when the inkjet head is moved in respective directions.

When the patterns are formed with the bi-directional print, variations of the thickness of the patterns due to difference of the gap at positions where the thickness measurement patterns are significant as described above. It is noted that, even in a one direction print, there occurs variation of the thickness of the patterns due to variation of the gaps.

This will be described in detail with reference to FIGS. 11A and 11B. In FIG. 11A, a position of the carriage 25 (or, inkjet head 26) indicated by solid lines shows a position at which the ink is ejected from the nozzles 31, while a position of the carriage 25 (or the inkjet head 26) indicated by two-dotted lines shows a position thereof when the ink ejected at the position indicated by the solid lines is spotted on the sheet.

As shown in FIG. 11A, while the inkjet head 26 mounted on the carriage 25 moves in one direction (i.e., in the right-hand direction in FIG. 11A), and the ink is ejected from a plurality of nozzles 31, if the gap is different from the ideal gap Ga, the spotted positions of the ink are displaced in the main scanning direction depending on the difference of the gap with respect to the ideal gap Ga. According to ordinary thinking, the displaced amount of the spotted positions due to the gap is the same for all the dots of the same pattern. That is, in FIG. 11A, a pattern consisting of dots A and formed on a plane at the ideal gap Ga, a pattern consisting of dots B and formed on a plane at a relatively small gap Gb and a pattern consisting of dots C and formed on a plane at a relatively large gap Gc have the same arrangement of the dots and only positions of the patterns are shifted in the main scanning direction.

The above is described under a presumption that one ink drop is ejected from one nozzle 31. However, it often occurs that a plurality of ink drops are ejected from one nozzle 31. For example, as shown in FIG. 11B, after a main ink drop Da is ejected from one nozzle 31, a satellite ink drop Db which has a much smaller volume than the main ink drop Da may be ejected afterward. When a plurality of ink drops are subsequently ejected from one nozzle 31, a satellite ink drop Db ejected at a certain timing is generally integrated with a main ink drop Da ejected at a next ejection timing, and the integrated ink drop is spotted on the print medium 100. If the gap is smaller than the ideal distance as shown in FIG. 11B, the main ink drop Da and the satellite ink drop Db may be spotted on the recording medium 100 separately, before they are integrated. As a result, in such an area, the thickness of the pattern is increased.

In regard with this phenomenon, four thickness measurement patterns are formed on four areas on the print sheet. However, it is difficult to judge how close the gap with respect to the ideal gap when each of the thickness measurement patterns is formed. Therefore, according to '849 JP patent, it is impossible to select a pattern corresponding to the gap which is the closest to the ideal gap from among the four thickness measurement patterns, and to execute the ejection adjustment based on the thus selected pattern.

According to aspects of the invention, there is provided an ejection adjustment pattern forming method of forming an ejection adjustment pattern on a print medium with an inkjet head, which has a plurality of nozzles from which ink is ejected, with moving the inkjet head in a predetermined scanning direction. The method includes the steps of forming a plurality of thickness measurement patterns respectively on a plurality of pattern forming areas defined on the print medium by causing the plurality of nozzles of the inkjet head to eject ink drops, and forming a plurality of judging patterns respectively on the plurality of pattern forming areas defined on the print medium, the plurality of judging patterns being used to judge closeness of conditions in terms of a gap between the inkjet head and the print medium with respect to an ideal condition representing an ideal gap between the inkjet head and the print medium when each of the plurality of thickness measurement patterns is formed.

In the step of forming the thickness measurement patterns, ejection conditions of the plurality of nozzles, when the plurality of thickness measurement patterns are formed, are the same among the plurality of pattern forming areas.

Further, the step of forming the judging patterns includes the steps of forming a line-like first judging pattern in each of the plurality of pattern forming areas by causing the plurality of nozzles, which are used when the thickness measurement pattern is formed in the each of the plurality of pattern forming areas, to eject the ink, and forming a line-like second judging pattern, which is different from the first judging pattern, in each of the plurality of pattern forming areas by causing the plurality of nozzles, which are used when the thickness measurement pattern is formed in the each of the plurality of pattern forming areas, to eject the ink. wherein the ejection conditions of the plurality of nozzles when the first judging pattern is formed and when the second judging pattern is formed are the same among the plurality of pattern forming areas.

According to the above configuration, in the plurality of pattern forming areas defined on the print sheet, a plurality of thickness measurement patterns and a plurality of judging patterns are formed, respectively. The plurality of judging patterns are used to judge degree of closeness of the condition, under which the plurality of thickness measurement patterns are formed, with respect to the ideal condition representing the ideal gap. The judging pattern includes a line-like first judging pattern and a line-like second judging pattern.

For the plurality of pattern forming areas, the ejection conditions of the plurality of nozzles when the thickness measurement patterns are formed are set to be the same condition. In addition, for the plurality of pattern forming areas, the ejection conditions of the plurality of nozzles used to form the first judging patterns and the second judging patterns are set to be the same. Therefore, if the gaps at all the pattern forming areas are the same and the ideal ones, the thickness of the thickness measurement patterns are the same among the plurality of pattern forming areas, and the positional relationship between the first judging pattern and the second judging pattern is the same among the plurality of pattern forming areas. If the gaps are uneven among the plurality of pattern forming areas, the thickness of the thickness measurement patterns may become thicker, and positional relationships of the first judging pattern and the second judging pattern may vary among the plurality of pattern forming areas.

It is preferable to use the thickness measurement patterns which are formed when the condition when the gap is formed is as close as the ideal condition. For this purpose, it is necessary to identify the thickness measurement pattern formed under the condition close to the ideal condition from among the plurality of thickness measurement patterns formed in the plurality of pattern forming areas. It is, however, difficult to find such a thickness measurement pattern from the view of the thickness measurement patterns. According to an exemplary embodiment, since the first and second judging patterns are line-like patterns, a positional relationship therebetween can be detected relatively easily. According to an exemplary embodiment, by detecting the positional relationship between the first and second judging patterns, it is possible to identify in which pattern forming area the thickness measurement pattern is formed in a condition closer to the ideal condition in terms of the gap.

According to aspects of the invention, among a plurality of pattern forming areas, the ejection conditions of the plurality of nozzles that form the thickness measurement patterns are set to be the same. In addition, the ejection conditions when first and second judging patterns are also set to the same among the plurality of pattern forming areas. If the gaps are uneven among the plurality of pattern forming areas, the thicknesses of the thickness measurement patterns vary, and the positional relationships between the first judging pattern and the second judging pattern in the pattern forming areas are shifted. It is, however, difficult to find such a thickness measurement pattern from the view of the thickness measurement patterns. According to an exemplary embodiment, since the first and second judging patterns are line-like patterns, a positional relationship therebetween can be detected relatively easily. According to an exemplary embodiment, by detecting the positional relationship between the first and second judging patterns, it is possible to identify in which pattern forming area the thickness measurement pattern is formed in a condition closer to the ideal condition in terms of the gap.

According to other aspects of the invention, there is provided an ejection adjustment pattern forming method of forming an ejection adjustment pattern on a print medium with an inkjet head, which has a plurality of nozzles from which ink is ejected, with reciprocally moving the inkjet head in a predetermined scanning direction. The method includes a thickness pattern forming step of forming a first thickness measurement pattern with the plurality of nozzles when the inkjet head is moving in one direction and a second thickness measurement pattern with the plurality of nozzles when the inkjet head is moving the other direction, and a judging pattern forming step of forming, in each of the plurality of pattern forming areas, a judging pattern, the judging pattern including a line-like first judging pattern which is formed with the same ones of the plurality of nozzles used to form the thickness measurement pattern when the inkjet head is moved in the one direction, and a line-like second judging pattern which is formed with the same ones of the plurality of nozzles used to form the thickness measurement pattern when the inkjet head is moved in the other direction, the judging pattern being used to judge how close a positional relationship between the first measurement pattern and the second measurement pattern in the predetermined scanning direction.

In each of the pattern forming areas, the ejection condition for the plurality of nozzles when the first thickness measurement pattern and the ejection condition for the plurality of nozzles when the first judging pattern is formed when the inkjet head is moved in the one direction are the same, and the ejection condition for the plurality of nozzles when the second thickness measurement pattern and the ejection condition for the plurality of nozzles when the second judging pattern is formed when the inkjet head is moved in the other direction are the same. Further, the ejection conditions of the plurality of nozzles are differentiated for the plurality of pattern forming areas so that the positional relationship between the first judging pattern and the second judging pattern in the predetermined scanning position are different among the plurality of pattern forming areas.

According to aspects of the invention, the thickness measurement patterns and the judging patterns are formed in the plurality of pattern forming areas with a bi-directional printing. In each of the pattern forming areas, the first thickness measurement pattern and the first judging pattern, which are formed when the inkjet head is moved in one direction, are formed by causing the nozzles to eject the ink under the same ejection condition, and the second thickness measurement pattern and the second judging pattern, which are formed when the inkjet head is moved in the other direction, are formed by causing the nozzles to eject the ink under the same ejection condition. In contrast, among the plurality of pattern forming areas, the ejection conditions are intentionally varied so that the positional relationship between the first judging pattern and the second judging pattern is different for different pattern forming area. Accordingly, the positional relationship in the scanning direction between the first thickness measurement pattern and the second thickness measurement pattern also varies.

As described above, by intentionally shifting the positional relationship between the first thickness measurement pattern and the second thickness measurement pattern in the main scanning direction, it is possible to realize an substantially ideal positional relationship between the first thickness measurement pattern and the second thickness measurement pattern in one of the pattern forming areas regardless of variation of the gap. It is difficult to judge whether the two thickness measurement patterns are formed under the ideal condition. However, since the two judging patterns are line-like patterns, the positional relationship therebetween can easily be detected. Therefore, by acquiring the positional relationship of the first and second judging patterns in each pattern forming area, it is possible to identify the pattern forming area in which the thickness measurement patterns are formed under the substantially ideal condition.

BRIEF DESCRIPTION OF THE ACCOMPANYING DRAWINGS

DETAILED DESCRIPTION OF THE EMBODIMENT AND MODIFICATIONS

Hereinafter, an inkjet printer 1 according to an embodiment of the invention will be described referring to the accompanying drawings.

Figure 1:
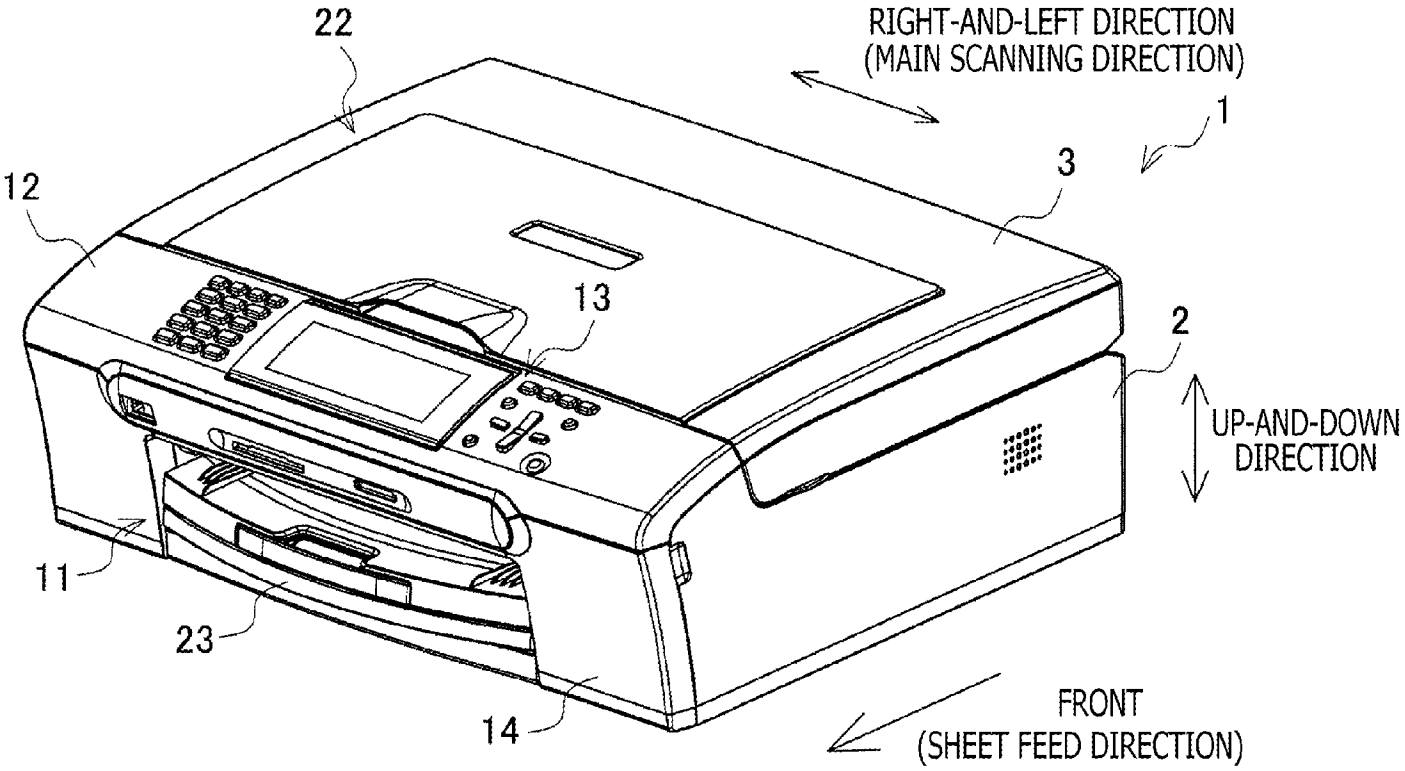
FIG. 1 is a perspective view of an inkjet printer according to an embodiment of the present invention.

In FIG. 1, an up-and-down direction, a right-and-left direction and a front-and-rear direction are defined when the inkjet printer 1 is placed for use.

Figure 2:
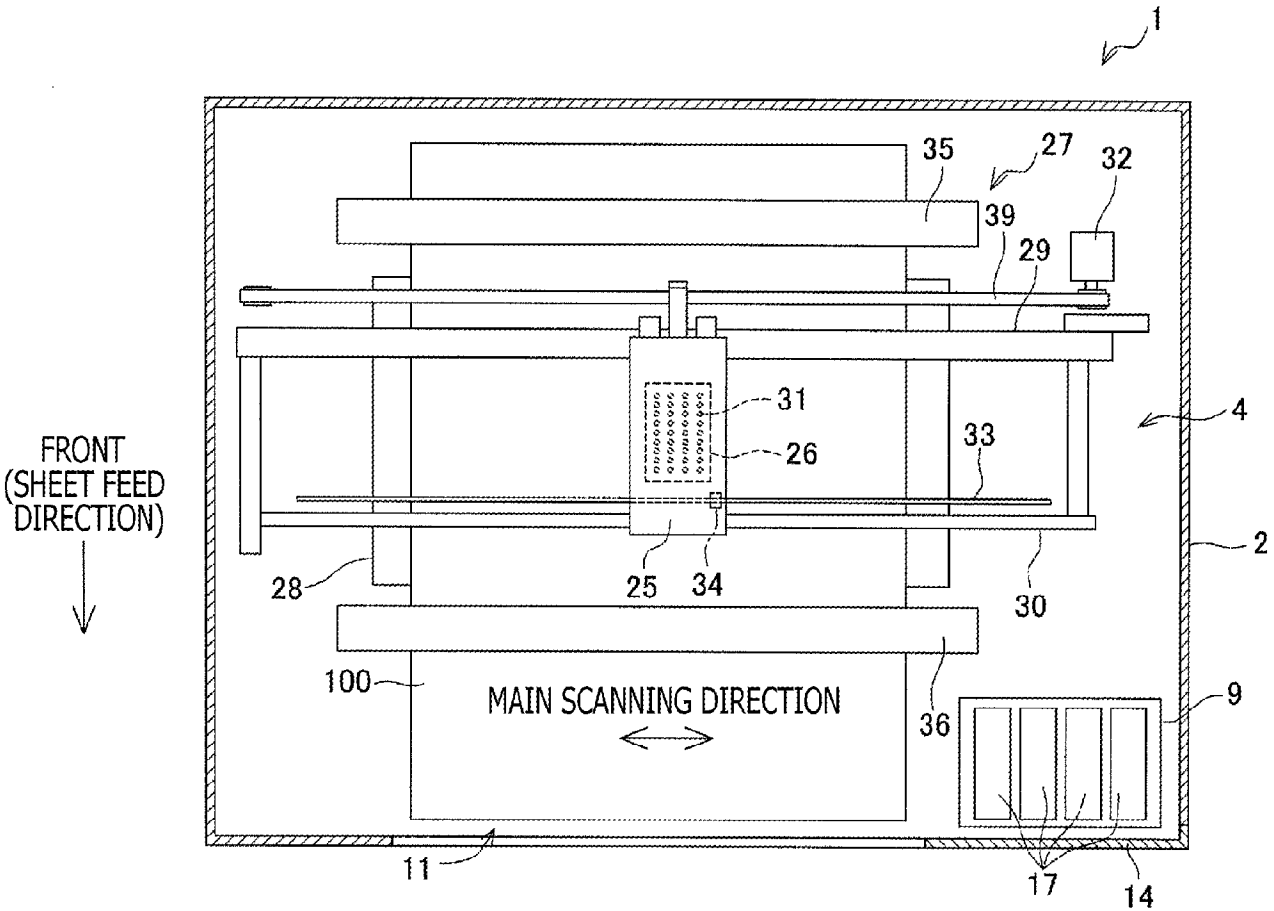
FIG. 2 is a plan view schematically showing an internal configuration of the inkjet printer shown in FIG. 1.

The inkjet printer 1 has a housing 2, a cover 3 which is rotatably attached to the housing 2. As shown in FIG. 2, the housing 4 accommodates a printer unit 4 which prints images on print sheet 100. A sheet discharge part 11 is formed on the housing 2. The sheet discharge part 11 is opened forward and the print sheet 100 on which an image is formed by the printer unit 4 is discharged therefrom. A part of the housing 2, on a front side of the cover 3, is formed with an inclined surface 12. On the inclined surface 12, an operation panel 13 is provided. A portion of the housing 2, on a right side of the discharge part 11, a lid 14 is attached. On a rear side of the lid 14, a holder 9, to which ink cartridges 17 for four colors (i.e., black, yellow, cyan and magenta) are attached, is arranged.

The cover 3 is arranged above the housing 2 so as to cover inner components such as the printer unit 4 accommodated in the housing 2. The cover 3 is attached to the housing such that the cover 3 is rotatable in the up-and-down direction about an axis at its rear end. With this configuration, when jammed sheet is removed or at a time of maintenance and inspection, inside of the housing can be exposed to outside by rotating the cover 3 upward. On the cover, a scanner unit 22 having a well-known image scanner is provided. As described above, the inkjet printer 1 according to the embodiment is configured as a multi-function peripheral capable of executing printing, scanning and copying.

The print sheets 100 accommodated in the sheet cassette 23 is fed one by one with a well-known sheet supply mechanism to the printer unit 4 (see FIG. 2). The printer unit 4 has a carriage 25 configured to reciprocally move in the right-and-left direction (i.e., in a main scanning direction), an inkjet head 26 mounted on the carriage 25 and a feeding mechanism 27 configured to feed the print sheet 100, supplied by the sheet supply mechanism, forwardly (i.e., in a sheet feed direction) along a horizontal plane.

In the housing 2, a platen 28 which supports the print sheet 100 from below is arranged horizontally. Above the platen 28, a pair of guide rails 29 and 30, which extend parallelly in the main scanning direction are provided. The carriage 25 is connected to a carriage drive motor 32 via an endless belt As the carriage drive motor 32 is driven and the endless belt 39 moves, the carriage 25 moves, within an area facing the print sheet 100 placed on the platen 28, in the main scanning direction as guided by the pair of guide rails 29 and 30.

The housing 2 is provided with a linear encoder 33 having a plurality of light-transmitting areas (e.g., slits) arranged in the main scanning direction an intervals. On the carriage 25, a light-transmission type encoder sensor 33 having a light emitting element and a light receiving element is arranged. Every time the encoder sensor 34 detects the light-transmission part of the linear encoder 33, the encoder sensor 34 outputs a detection signal. The printer 1 recognizes a location of the carriage 25 in the main scanning direction based on the number of the detection signals.

The inkjet head 26 is attached on a lower part of the carriage 25 so as to have a gap with respect to the platen 28. On a lower surface of the inkjet head 26 (i.e., on a surface on a farther side of a plane of FIG. 2), a plurality of nozzles 31 are formed. The plurality of nozzles 31 are aligned in the sheet feed direction such that four lines of nozzles respectively eject four colors of ink (i.e., black, yellow, cyan and magenta). The inkjet head 26 is connected with the holder 9 via tubes (not shown). The four colors of ink reserved in four ink cartridges 17 are supplied to the inkjet head 26 via the tubes.

The inkjet head 26 is provided with actuators (not shown) which apply ejection energy to the four colors of ink in the plurality of nozzles 31. The configuration of the actuators need not be limited to a particular ones. For example, a piezoelectric type actuators, which make use of distortion which is generated when a voltage is applied to a piezoelectric layer, can be employed. The inkjet head 26 selectively applies the ejection energy to each of the ink in the plurality of nozzles 31 so that the ink is ejected from the plurality of nozzles 31 independently.

Figure 3:
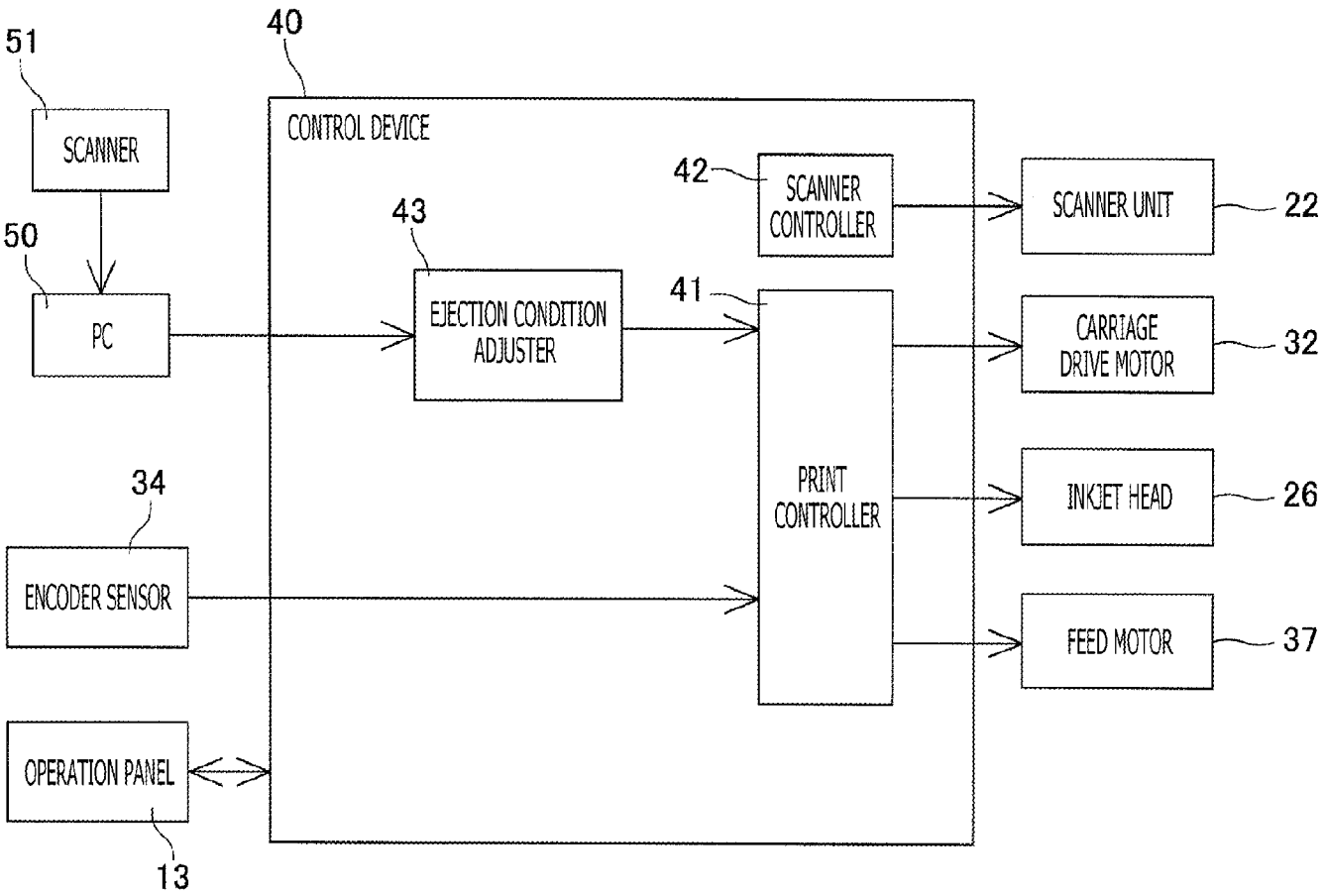
FIG. 3 is a block diagram schematically showing an electrical configuration of the inkjet printer shown in FIG. 1.

The feeding mechanism 27 has two rollers 35 and 36 which are arranged in the front-and-rear direction to sandwich the platen 28 and the carriage 25. Each of the rollers 35 and 36 is driven to rotate by the drive motor 37 (see FIG. 3), and feeds the print sheet 100 forwardly (i.e., in the feeding direction) between the inkjet head 26 and the platen 28.

The printer unit 4 described above makes the carriage 25 move in the main scanning direction (i.e., in the right-and-left direction in FIG. 1) relative to the print sheet 100 placed on the platen 28, and makes the plurality of nozzles 35 eject the ink onto the print sheet 100. When the movement of the carriage 25 in the main scanning direction (which is also called as a pass) is finished, the printer unit 4 causes the feeding mechanism 27 and the two feed rollers 35 ad 36 to feed the print sheet 100 in the feeding direction by a predetermined amount. By alternately repeating the pass of the carriage 25 and feeding of the print sheet 100, a desired image is printed on the print sheet 100.

The printer 1 according to the embodiment is capable of execute printing when the carriage 25 moves in either of the right-and-left direction. That is both when the inkjet head 26 moves in one direction of the main scanning direction (i.e., moves rightward in FIG. 2) and when the inkjet head 26 moves in the other direction (i.e., leftward in FIG. 2), the ink is ejected from the plurality of nozzles 31 to form an image on the print sheet 100.

Next, an electrical configuration of the printer 1 will be described. A controlling device 40, which controls an entire operation of the inkjet printer 1 has a CPU (central processing unit), a ROM (read only memory), a RAM (random access memory) and a control circuit. The controlling device 40 is connected with various operational components such as the operation panel 13, the inkjet head 26 and the like. Such components of the controlling device 40 serve as a record control unit 41, a scanner control unit 42, an ejection condition adjustment unit 43 and the like shown in FIG. 3. Further, the controlling device 40 is connected to a PC 50 as an external apparatus.

To the record control unit 41, an output signal of the encoder sensor 34 is input, thereby the record control unit 41 recognizes a position of the inkjet head 26 in the main scanning direction. The record control unit 41 controls the carriage drive motor 32 which drives the carriage 25 to move, the inkjet head 26, the feed motor 37 that drives the feed rollers 35 and 36 to rotate, based on data regarding an image to be printed, which is transmitted from the PC 50, thereby a desired image is printed on the print sheet 100. The record control unit 41 is capable of controlling the above-described components of the printer 1 to print ejection adjustment patterns in order to adjust ejection condition of the plurality of nozzles 31 on the print sheet 100.

The scanner control unit 42 controls operation of the scanner unit 22 when an image is scanned. The ejection condition adjusting unit 43 adjusts the ejection condition of each of the plurality of nozzles 31 of the inkjet head 26 based on information regarding the ejection adjustment patterns.

Hereinafter, the ejection adjustment of the nozzles 31 of the inkjet printer 26 will be described. It is noted that, in the following description, the ejection adjustment is performed for each of the flour lines of the nozzles respectively corresponding to the four color ink (i.e., black ink, yellow ink, cyan ink and magenta ink).

General Description of Ejection Adjustment

When the four lines of nozzles 31 have the same ejection characteristics (i.e., an ejection amount of an ink drop, an ejection speed of the ink drop), if the ink is ejected from the plurality of nozzles 31 at the same timing, the same volume of ink drop ejected from each of the plurality of nozzles 31 is spotted on the print sheet 100 evenly. In such a case, the thickness of an image formed on the print sheet 100 is even. In practice, however, due to variation of actuator characteristics for applying energy to the ink inside the nozzles 31 and the like, the ejection characteristics of the plurality of nozzles 31 generally become uneven. In this case, the size of the ink spots and/or the spotted positions of the ink drops vary and the formed image includes uneven thickness.

Figure 4:
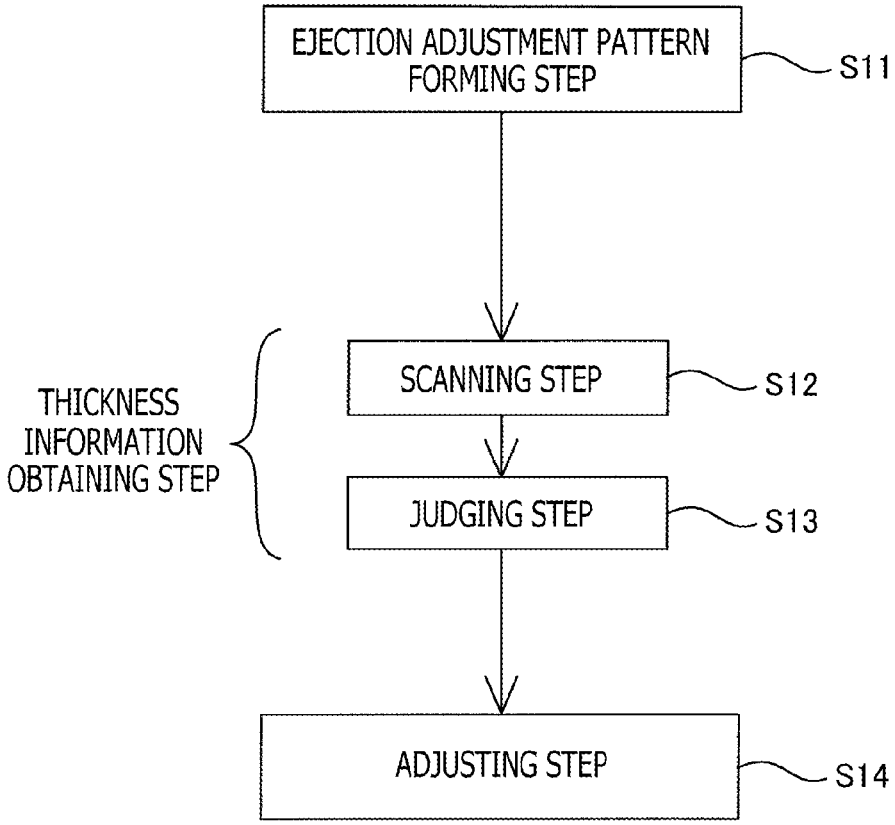
FIG. 4 is a process chart of an ink ejection adjustment of a nozzle of the inkjet printer shown in FIG. 1.

Therefore, the ejection conditions of the plurality of nozzles 31 are adjusted in accordance with three steps below to that the unevenness of the thickness due to unevenness of the ejection characteristics of the plurality of nozzles 31 is suppressed. The process of adjusting the ejection characteristics of the nozzles 31 is schematically shown in FIG. 4.

(1) Causing each of the plurality of nozzles 31 to eject an ink drop with moving the inkjet head 26 in the main scanning direction to form a predetermined ejection adjustment pattern on the print sheet 100 (i.e., an ejection adjustment pattern forming step S11).

(2) Scanning the ejection adjustment pattern with the scanner 51 to obtain thickness information of the ejection adjustment pattern (information regarding unevenness of the thickness) (i.e., a thickness information obtaining step which includes a scanning step S12 and a correlation obtaining step S13).

(3) Adjusting the ejection condition of each of the plurality of nozzles 31 based on the thickness information of the ejection adjustment pattern (i.e., an adjusting step S14).

Figure 11A:
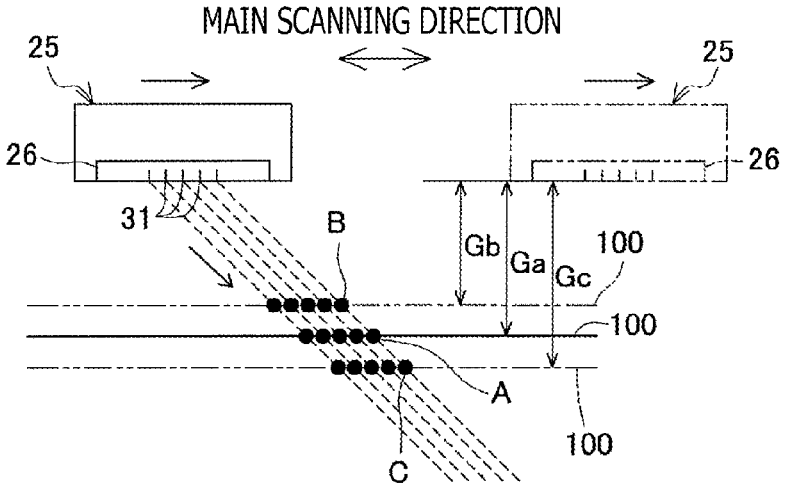
FIG. 11A is a chart illustrating spotted positions of the ink when a one way printing is executed.
Figure 11B:
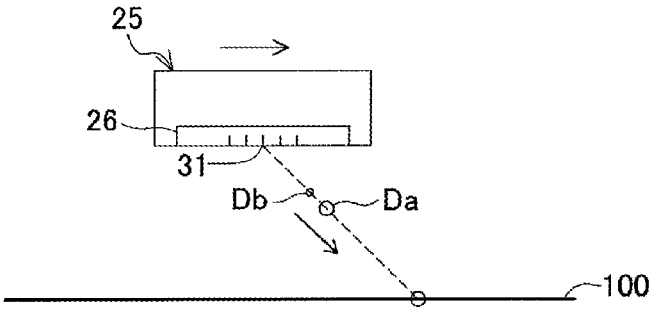
FIG. 11B is a chart illustrating ejection of a main ink drop and a satellite ink drop.

The ejection adjustment pattern generating step includes, as shown in FIG. 11, a step of generating thickness measurement patterns S01 and a step of generating judging patterns S02. Specifically, in S01, a plurality of thickness measurement patterns are formed respectively in a plurality of pattern forming areas defined on the print medium by causing the plurality of nozzles 31 to eject ink drops. Then, in S02, a plurality of judging patterns are formed respectively in the plurality of pattern forming areas defined on the print medium. The plurality of judging patterns are used to judge closeness of conditions in terms of a gap between the inkjet head 26 and the print medium with respect to an ideal condition representing an ideal gap between the inkjet head and the print medium when each of the plurality of thickness measurement patterns is formed.

The ejection condition above is a condition which affects the size of the ink drop ejected from each nozzle 31 and the spotted position. Specifically, the ejection condition includes an ejection timing condition and an ejection energy condition.

The ejection timing condition is a condition regarding a chronological shifting amount representing an actual ejection timing with respect to a reference ejection timing that is a predetermined timing at which an ink drop is spotted at a predetermined target spot position on the print sheet 100. More specifically, the chronological shifting amount is a chronological delay amount (or, an ejection delay amount) from the transparent part (e.g., slit) of the linear encoder corresponding to the predetermined target spot position is detected by the encoder sensor 34 till the ink drop is actually ejected. If the spotted position of the ink drop ejected from a certain nozzle 31 is shifted in relation to other spotted positions corresponding to other nozzles 31, by adjusting the ejection timing of the certain nozzle 31 corresponding to the shifted spotted position, the spotted position of the ink ejected from the certain nozzle 31 can be aligned in relation to other spotted positions.

The ejection energy condition represents an amplitude of the ejection energy applied to the ink in each nozzle 31, which energy is applied by the actuator of the inkjet head 26. If the actuator is a piezoelectric actuator, the energy corresponds to a driving voltage applied to the piezoelectric layer for each nozzle 31. Even if the ejection energy conditions are the same among the plurality of nozzles 31, the size and/or the speed of the ink drops respectively ejected from the plurality of nozzles 31 may vary as degree of loss of energy varies in each nozzle 31 due to difference of flow path resistances and the like, the size and/or speed of the ink drop differs, therefore, the spotted positions are different. In such a case, by adjusting the ejection energy conditions of respective nozzles 31, the size and/or speed of the ink spots can be unified (i.e., the spotted positions can be adjusted).

Firstly, a step of forming the ejection adjustment patterns on the print sheet 100 will be described. In order to suppress the unevenness of the thickness of the image formed in the bi-directional printing, the ejection adjustment patterns are also formed in the bi-directional printing. Incidentally, the gap between the inkjet head 26 and the print sheet 100 is not necessarily constant over an entire area of the print sheet 100. Due to rising and/or bending of the print sheet 100, or corrugated shape of the print sheet 100, the gap may be different from the ideal value (predetermined value) depending on a position.

Figure 5:
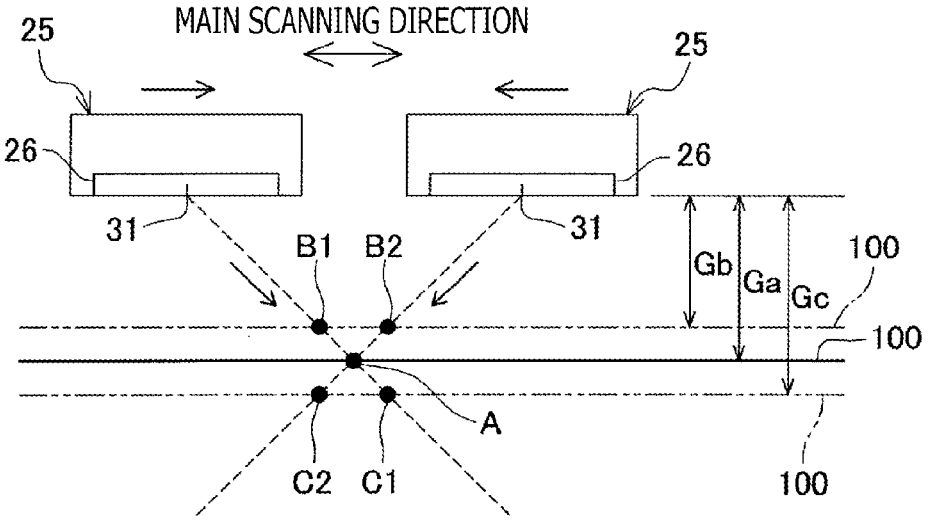
FIG. 5 shows spotted positions of the ink drops when a bi-directional printing is executed.

When the gap is an ideal value Ga, it is assumed that the ink drops ejected during the forward movement and reverse movement of the carriage 25 are spotted on the same position A as shown in FIG. 5. If the gap is a smaller gap Gb than the ideal gap Ga, the ink drops ejected during the forward and reverse movements are spotted on positions B1 and B2 which are closer to positions where the ink drops are ejected than the position A. If the gap is a larger gap Gc than the ideal gap Ga, the ink drops ejected during the forward and reverse movements are spotted on positions C1 and C2, which are farther from the positions where the ink drops are ejected than the position A.

As above, ideally, the ink drops ejected during the forward and reverse movements of the carriage 25 are spotted at position A. If the gap is small, the ink drops are spotted at positions B1 and B2. If the gap is large, the ink drops are spotted at positions C1 and C2. Thus, in the bi-directional printing, the spotted positions are shifted not only the unevenness of the ejection characteristics among the plurality of nozzles 31, but also the gap between the inkjet head 26 and the print sheet 100.

If the ejection adjustment patterns are formed without taking the above-described problem of the gap, it is impossible to judge whether the unevenness of the thickness of the ejection adjustment patterns is due to the unevenness of the ejection characteristics among the nozzles 31 or due to the gap. Therefore, when the ejection adjustment is done in the bi-directional printing, it is necessary to exclude the effects of the variation of the gap as much as possible.

Figure 6:
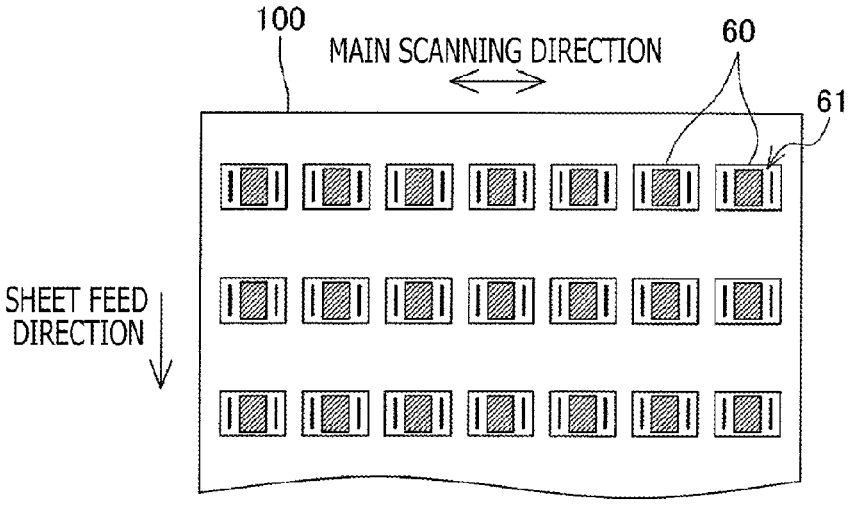
FIG. 6 shows an example of the ejection adjustment pattern.

FIG. 6 shows an example of the ejection adjustment patters formed on the print sheet 100. As shown in FIG. 6, a plurality of ejection adjustment patterns 61 are formed in a plurality of areas (i.e., pattern forming areas 60) on the print sheet 100, respectively. It is noted that the plurality of pattern forming areas 60 are arranged regularly in the main scanning direction and the feeding direction. That is, a plurality of ejection adjustment patterns 61, which are arranged in matrix (i.e., regularly arranged in the main scanning direction and the feeding direction) are formed on the print sheet 100.

Figure 7A:
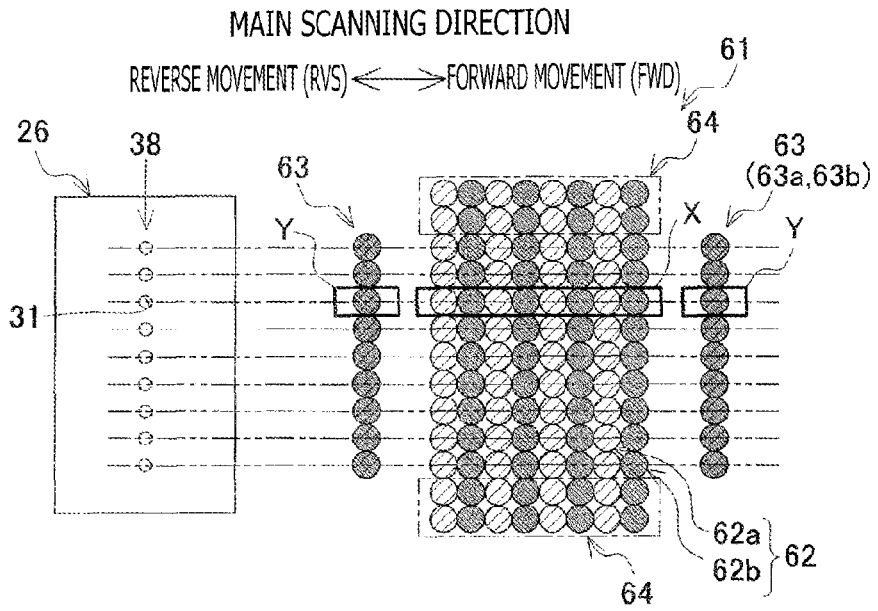
FIGS. 7A and 7B show an example of the ejection adjustment pattern formed in one pattern forming area.
Figure 7B:
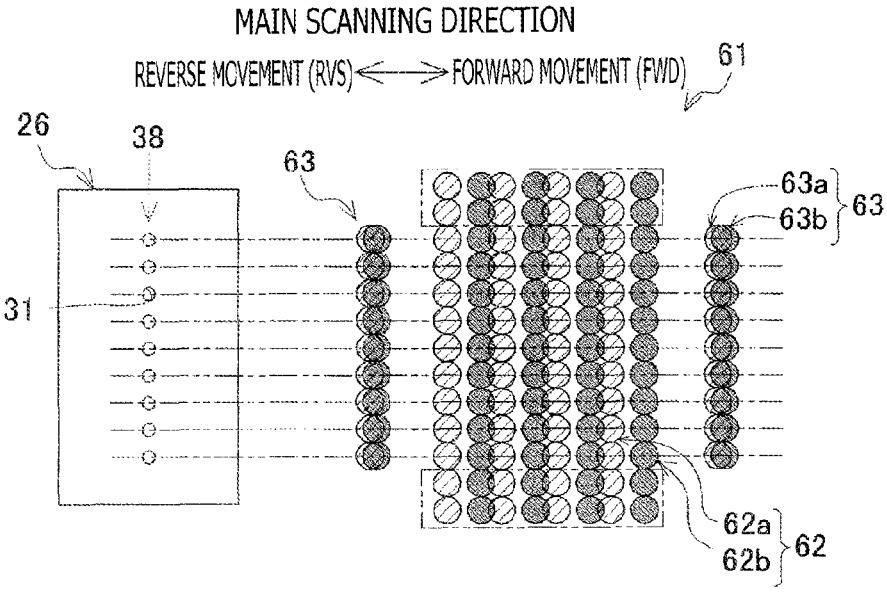

FIGS. 7A and 7B show an ejection adjustment pattern 61 formed on one pattern forming area 60. As shown in FIGS. 7A and 7B, the ejection adjustment pattern 61 in one pattern forming area 60 includes a thickness measurement pattern 62 and two judging patterns 63 arranged to sandwich the thickness measurement pattern 62 in the main scanning direction. Incidentally, the ejection adjustment pattern 61 is formed as the record control unit 41 of the control device 40 controls the printer unit 4.

The thickness measurement pattern 62 is a filled pattern including a first thickness measurement pattern 62*a* and a second thickness measurement pattern 62*b*. The first thickness measurement pattern 62*a* includes a lot of dot lines (indicated with thin hatch) arranged in the main scanning direction at predetermined intervals. Specifically, the interval is twice a pitch of lines of the nozzles. The first thickness measurement pattern 62*a* is formed by controlling a plurality of nozzles 31 constituting a line 38 when the inkjet head 26 is forwardly moved.

The second thickness measurement pattern 62*b* includes a plurality of lines of dots (indicate with thin hatch) similarly to the first thickness measurement pattern 62*a*. It is noted that the second thickness measurement pattern 62*b* is formed when the inkjet head 26 is reversely moved. Further, the second thickness measurement patterns 62*b* are formed such that each line of the dots of the second measurement pattern 62*b* is located between two adjoining lines of dots of the first thickness measurement pattern 62*a*.

In a preferred embodiment, the thickness measurement patterns 62 are formed such that each pattern has a width, in the main scanning direction, of 10-20 mm. If the pattern has a certain width (i.e., a certain number of lines), a plurality of pieces of thickness data can be obtained for each nozzle 31. In a preferred embodiment, the thickness data for a nozzle 31 in the pattern forming area 60 is determined by averaging a plurality of pieces of the thickness data obtained in relation to the pattern forming area 60 in which the pattern is formed.

As shown in FIGS. 7A and 7B, on an upstream side and a downstream side, in the feeding direction, of the thickness measurement patterns 62, dummy patterns 64, which are filled patterns similar to the thickness measurement pattern 62, are formed. The upstream side dummy pattern 64 is formed by other passes before the thickness measurement patterns 62 are formed, while the downstream side dummy patterns 64 are formed by other passes after the thickness measurement patterns 62 are formed.

If end portions, on the upstream side and the downstream side of the thickness measurement pattern 62 (i.e., the portions formed by the ink drops ejected by the nozzles 31 at the end of the nozzle line 38), adjoins white areas where no patterns are formed, scanning error may increase due to light reflected by a white print sheet 100 when the thickness measurement patterns 62 are scanned with the scanner 51. In the exemplary embodiment, by forming the dummy patterns 64 so as to adjoin the thickness measurement patterns 62, the above-described problem of scanning error can be suppressed.

Each judging pattern 63 includes a first judging pattern 63*a* and a second judging pattern 63*b*. The first judging pattern 63*a* is a linear pattern (i.e., linearly arranged dots) extending in the feeding direction, which is formed by making a plurality of nozzles 31 constituting a line 38 of nozzles 31 eject ink dots, when the inkjet head 26 is forwardly moved. The second judging pattern 63B is a linear pattern (i.e., linearly arranged dots) extending in the feeding direction, which is also formed by making a plurality of nozzles 31 constituting a line 38 of nozzles 31 eject the ink dots, when the inkjet head 26 is reversely moved.

The second judging pattern 63*b* is formed to overlap, in the feeding direction, the first judging pattern 63*a*. The judging pattern 63 is formed using the same nozzles 31 (i.e., the same color) as those used for forming the thickness measurement patterns 62. The judging pattern 63 is formed at a position a predetermined distance spaced from the thickness measurement patterns 62. Since the judgment patterns 63 are spaced from the thickness measurement patterns 62, when the judgment patterns 63 are scanned, effects of the thickness measurement patterns 63 can be suppressed. For this purpose, it is preferable that the judgment patterns 63 are spaced from the thickness measurement patterns 62 by 3 mm-5 mm. Since the judgment pattern 63 is used for displacement of the spotted position, it is sufficient if at least one linear pattern is included as shown in FIG. 7. However, the number of the linear pattern could be more than one.

The thickness measurement pattern is formed such that, when the gap between the inkjet head 26 and the print sheet 100 is a predetermined ideal value (hereinafter, this state will be referred to as an ideal condition), the first thickness measurement pattern 62*a* and the second thickness measurement pattern 62*b* have a predetermined positional relationship. FIG. 7A shows the ejection adjustment pattern when the gap is in the ideal condition. Specifically, as shown in FIG. 7A, when the gap is in the ideal condition, the ejection condition is set such that each dot of the second measurement pattern 62*b* is located at a dead center between two adjacent dots of the first thickness measurement pattern 2*a*. Under such condition, the thickness measurement pattern 62 is formed as a filled pattern in which dot arrangement (i.e., the thickness) is even as the dots formed by moving the inkjet head 26 in both directions are evenly arranged in the main scanning direction and in the feeding direction. In this specification, an expression that dots are evenly arranged means that a distance between any one of the dots and any one of the adjacent dots is the same. It is noted that, in this ideal condition, only when the ejection characteristics of all of the plurality of nozzles 31 are the same, the dots are evenly arranged. If there is unevenness among the ejection characteristics among the plurality of nozzles 31, spotted positions of part of the nozzles 31 are displaced. That is, under the ideal condition of the gap, if the ejection characteristics of the plurality of the nozzles 31 are the same, the dots are evenly arranged. Therefore, it becomes easier to find the unevenness of the thickness when the ejection characteristics of the plurality of nozzles 31 are uneven. In this sense, the expression that the dots are evenly arranged means that the even arrangement of the dots are realized on assumption that the ejection characteristics of all the nozzles 31 are the same. Thus, it does not mean that the dots are evenly arranged when the pattern is formed under a condition that the ejection characteristics of the nozzles 31 are uneven.

Further, the judging pattern 63 is formed such that the first judging pattern 63*a* and the second judging pattern 63*b* have a predetermined positional relationship when the gap is in the ideal condition. Specifically, as shown in FIG. 7A, the ejection condition is set such that, when the gap is in the ideal condition, the first judging pattern 63*a* and the second judging pattern 63*b* completely overlap.

Furthermore, among the plurality of pattern forming areas 60, the ejection conditions of the plurality of nozzles 31 are set to be identical. Therefore, the gap is ideal and constant over the entire area of the print sheet 100, in each of the plurality of the pattern forming areas 60, the thickness measurement pattern 62 is formed as the filled pattern in which the plurality of dots are evenly arranged as shown in FIG. 7A, and the judging pattern 63 is formed such that the first judging pattern 62*a* and the second judging pattern 62*b* completely overlap each other.

If there is unevenness of gap among the plurality of pattern forming areas 60, in areas of which the gap is different from the ideal value, displacement of the spotted positions due to the difference o the gap is exhibited in the thickness measurement pattern 62 and the judging pattern 63. FIG. 7B shows the ejection adjustment pattern when the gap is not the ideal condition. If the gap is different from the ideal value, the first thickness measurement pattern 62*a* and the second thickness measurement pattern 62*b* are displaced in the main scanning direction, and lots of dots are displaced from the evenly arranged positions as shown in FIG. 7B. In this case, an area in which the ink drops are actually spotted is smaller in comparison with a case shown in FIG. 7A, the thickness measurement pattern 62 exhibits a lower thickness.

Regarding the judging pattern 63, the first judging pattern 63*a* and the second judging pattern 63*b* are displaced in the main scanning direction as shown in FIG. 7B. In comparison with a case, shown in FIG. 7A, where the first judging pattern 63*a* and the second judging pattern 63*b* completely overlap each other, a line thickness of the judging pattern 63 becomes thicker. Thus, based on the degree of the displacement between the first judging pattern 63*a* and the second judging pattern 63*b* (i.e., the line thickness of the judging pattern 63), it is known how close the condition in which the thickness measurement pattern 62 is formed in comparison with the ideal condition of the gap.

Thickness Information Obtaining Step

The thickness information obtaining step includes a scanning step (S12) and a judging step (S13) as shown in FIG. 4. In the scanning step (S12), a plurality of the ejection adjustment patterns 61 formed on the print sheet 100 are scanned using the scanner 51 connected to the PC 50. The pattern information scanned by the scanner 51 is transmitted to the PC 50. The PC 50 obtains, for each of the plurality of ejection adjustment patterns 61, thickness information of part of the thickness measurement pattern 62 and part of the judging pattern 63 formed by each nozzle 31 in an associated manner.

For example, regarding the nozzle 31 which is located at third position from the top in FIG. 7A, the PC 50 obtains the thickness information of the thickness measurement pattern 62 in a thick frame X in FIG. 7A and the thickness information of the judging pattern 63 in a thick frame Y in FIG. 7A which are formed by the third nozzle 31 in an associated manner.

It is noted that correspondence of the thickness information of a part of the thickness measurement pattern 62 and the judging pattern 63 with respect to a nozzle 31 can be recognized as indicated below. That is, in the pattern forming step, in each of the pattern forming areas 60, a reference pattern is formed using a predetermined nozzle 31 in addition to the ejection adjustment pattern 61. Then, in the thickness information obtaining step, the nozzle 31 used for forming the part of the thickness measurement pattern 62 and the judging pattern 63 is identified based on how the thickness measurement pattern 62 and the judging pattern 63 are spaced from the reference pattern.

In the judging step, it is judged the thickness measurement pattern 62 of which pattern forming area 60 is formed under a condition closest to the ideal condition in terms of the gap. However, it is very difficult to make such a judgment by detecting the degree of the displacement between the thickness measurement patterns 62*a* and 62*b* from the thickness information of the thickness measurement pattern 62 since it is a filled pattern. In the exemplary embodiment, the judgment is made based on a positional relationship, in the main scanning direction, between the first judging pattern 63*a* and the second judging pattern 63*b*. Since the two patterns 63*a* and 63*b* are linear patterns, unlike the thickness measurement patterns 62*a* and 62*b*, it is relatively easy to detect the shifting amount between the first judging pattern 63*a* and the second judging pattern 63*b* in the main scanning direction.

Specifically, the PC 50 detects, for each nozzle 31, a pattern forming area 60 in which the thickness of a part of the judging pattern 63 formed by the nozzle 31 is the lowest (i.e., the shift amount between the two judging patterns 63*a* and 63*b* is the smallest and the line thickness of the judging pattern 63 is the smallest), and identifies thus detected pattern forming area 60 as the pattern forming area at which the gap is closest to the ideal gap. The thickness information of the thickness measurement pattern 62 of the identified pattern forming area 60 is used as the information for ejection adjustment of the nozzle 31. For each the nozzles 31, the above process is performed to obtain the thickness information of the thickness measurement pattern 62 which is formed under a condition close to the ideal condition.

According to the embodiment, when the gap is in the ideal condition, the judging pattern 63 is formed such that the first judging pattern 63*a* and the second judging pattern 63*b* completely overlap each other. When the first judging pattern 63*a* and the second judging pattern 63*b* completely overlap, the line thickness of the judging pattern 63 becomes smallest. Therefore, by comparing the line thicknesses of the judging patterns 63 respectively formed in the plurality of pattern forming areas 60, which thickness measurement pattern 62 is formed in a condition closest to the ideal condition can easily be judged.

The above judgment is made under a presumption that the gap is substantially the same in the forming areas of the thickness measurement pattern 62 and the forming areas of the judging pattern 63. Therefore, it is preferable that the thickness measurement pattern 62 and the judging pattern 63 in the same pattern forming area 60 are close to each other.

Incidentally, according to the embodiment, two judging patterns 63 are formed at both ends in the main scanning direction. With this configuration, it is possible to recognize that the gaps at both ends are different based on the judging pattern 63 at both ends.

For example, if the thickness of the judging pattern 62 at one end is relatively small, and the thickness of the judging pattern 62 at the other end is relatively large, it is assumed that the gaps at both ends are significantly different within the pattern forming area 60. In such a case, the thickness information of the thickness measurement pattern 62 in that area may not be used for ejection adjustment.

It is noted that forming the judging patterns 63 on both sides of the thickness measurement pattern 62 is not always necessary. In an another embodiment, it is possible to form the judging pattern 63 only on one side of the thickness measurement pattern 62.

In the above description, the PC 50 connected to the scanner 51 identifies the thickness measurement pattern 62 which is formed under a condition closest to the ideal condition in terms of the gap. However, such a configuration may be modified such that the controlling device 40 of the printer 1 may be configured to perform such a function.

Adjustment Step

In the adjustment step, the ejection condition adjustment unit 43 of the controlling device 40 adjusts the ejection condition of each of the plurality of nozzles 31 when the bidirectional printing is performed, based on the thickness information of the thickness measurement pattern 62 for each of the plurality of nozzles 31 transmitted from the PC 50.

As described above, according to the embodiment, when the thickness measurement patterns 62 are formed in the plurality of pattern forming areas 60, the ejection conditions of the plurality of nozzles 31 are made identical. Further, when the judging patterns 63*a* and 63*b* are formed, the ejection conditions for the plurality of nozzles 31 are the same among the plurality of pattern forming areas 60. Therefore, if the gaps in all the pattern forming areas 60 exhibit the ideal value, the thickness of the thickness measurement patterns 62 in the plurality of pattern forming areas 60 are the same, and positional relationships between the first judging pattern 63*a* and the second judging pattern 63*b* (i.e., the thickness of the judging pattern 63) become the same. In contrast, if the gaps vary among the plurality of pattern forming areas 60, the thicknesses of the thickness measurement patterns 62 in respective pattern forming areas 60 are different, and the positional relationships between the first judging patterns 63*a* and the second judging patterns 63*b* in respective pattern forming areas 60 are also different.

For the ejection adjustment of the plurality of nozzles 31, it is preferable to use the thickness measurement patterns which are formed in a condition closer to the ideal condition in terms of the gap. According to the embodiment, in each of the pattern forming areas 60, the first and second judging patterns 63*a* and 63*b* (of the judging pattern 63) corresponding to the thickness measurement pattern 62 are linear patterns. Therefore, it is relatively easy to recognize a positional relationship between the first and second judging patterns 63*a* and 63*b*. By recognizing the positional relationship between the first and second judging patterns 63*a* and 63*b*, it is possible to detect the thickness measurement patterns 62 of which ones of the pattern forming areas 60 are formed under a condition close to the ideal condition in terms of the gap.

As shown in FIG. 6, according to the embodiment, the plurality of pattern forming areas 60 are arranged in the main scanning direction and the feeding direction. Therefore, the ejection adjustment can be made against variations of the gap in the main scanning direction and the feeding direction. for example, if the plurality of pattern forming areas 60 are arranged only in the main scanning direction, and if the gap varies largely along the feeding direction, the ejection adjustment pattern 61 may be formed at a position where the gap is extremely large or extremely small. That is, in such a case, the ejection adjustment pattern 61 may not be formed at the position where the gap exhibits the ideal value. According to the exemplary embodiment, since the plurality of pattern forming areas 60 are arranged both in the main scanning direction and the feeding direction, the above problem may not be occur.

Hereinafter, modifications of the above-described exemplary embodiment will be described. In the following modifications, to components having the same configuration as in the exemplary embodiment, the reference numbers same as in the exemplary embodiment are assigned and description thereof is simplified/omitted for brevity.

In the exemplary embodiment, the thickness information of the thickness measurement pattern 62 in which one of the pattern forming areas 60 is individually determined for each of the plurality of nozzles 31. If the gap is substantially unchanged in the nozzle arranged direction (which is the feeding direction in the exemplary embodiment) and therefore the condition regarding the gap is substantially the same for the nozzles 31 in the line 38 of the nozzles 31, it is not necessary to make the above judgment for all the nozzles 31 of the line 38. For example, identification of the thickness measurement pattern 62 which is formed in a condition closest to the ideal condition is done for only one nozzle 31, and the ejection adjustment for all the nozzles 31 may be done based on the one piece of the thickness information of the thickness measurement pattern 62 as identified.

According to the exemplary embodiment, the thickness measurement pattern 62 which is formed under a condition closer to the ideal condition in terms of the gap is selected among the plurality of thickness measurement patterns 62 formed in the plurality of pattern forming areas 60, respectively. In such a case, the selected thickness measurement pattern 62 may corresponding to the one formed under the condition closer to the ideal condition among the plurality of thickness measurement patterns 62. In view of improving precision of the ejection adjustment in the adjustment step, it is preferable to obtain the thickness information of the pattern which is formed under a condition which is ultimately closer to the ideal condition in terms of the gap. If the number of the thickness measurement patterns 62 is increased, the precision may be improved. However, there is a limitation in increasing the number of the thickness measurement patterns 62. In this regard, according to a modification, the thickness of the thickness measurement pattern 62 formed under the ideal condition in terms of the gap may be presumed based on a plurality of pieces of information regarding the ejection adjustment patterns 61 scanned by the scanner, as described below.

Figure 8:
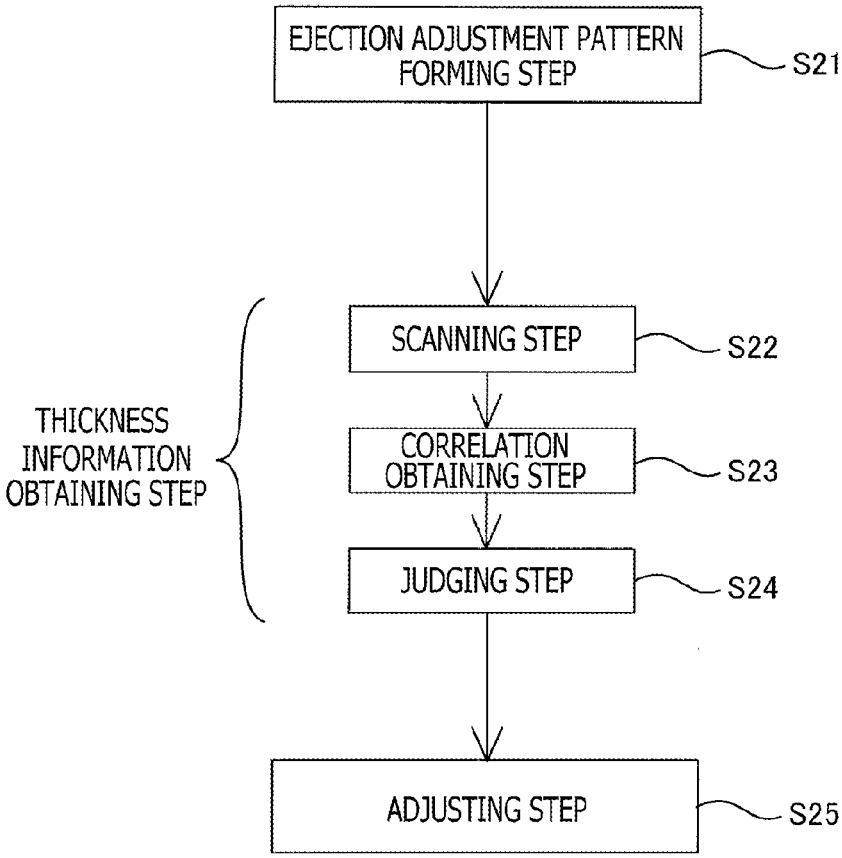
FIG. 8 shows a process chart of the ejection adjustment of the nozzles according to a modified embodiment.

In the modification shown in FIG. 8, the step of forming the ejection adjustment patterns (S21) is substantially similar to the step S11 of forming the ejection adjustment patterns 61 employed in the exemplary embodiment (see FIGS. 6, 7A and 7B), and description thereof is omitted for brevity. The thickness information acquiring step according to the modification includes a scanning step (S22), a co-relation obtaining step (S23) and a presuming step (S24). Subsequently, an adjustment step (S25) is executed.

Figure 12:
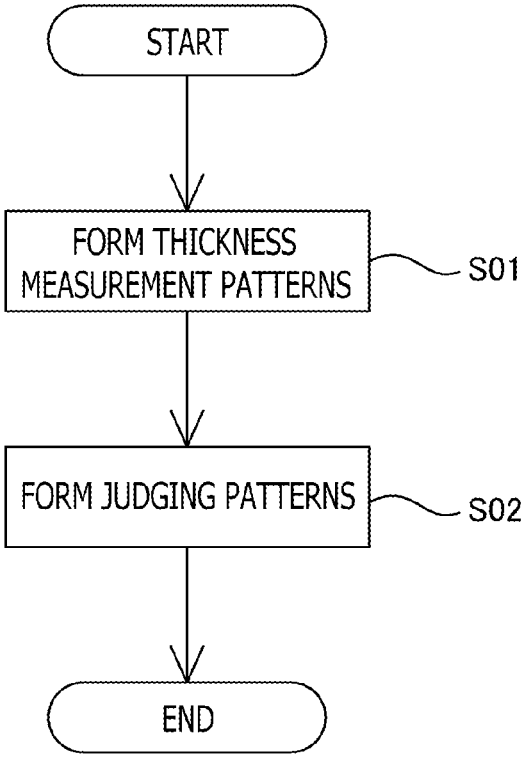
FIG. 12 is a flowchart illustrating an ejection adjustment pattern forming step.

Specifically, in the modification, a first thickness measurement pattern is formed with the plurality of nozzles when the inkjet head is moving in one direction, and a second thickness measurement pattern is formed with the plurality of nozzles when the inkjet head is moving the other direction (FIG. 12, S01). Then, in each of the plurality of pattern forming areas, a judging pattern is formed (FIG. 12, S02). The judging pattern includes a line-like first judging pattern which is formed with the same ones of the plurality of nozzles 31 used to form the thickness measurement pattern when the inkjet head 26 is moved in the one direction, and a line-like second judging pattern which is formed with the same ones of the plurality of nozzles 31 used to form the thickness measurement pattern when the inkjet head 26 is moved in the other direction. The judging pattern is used to judge how close a positional relationship between the first measurement pattern and the second measurement pattern in the predetermined scanning direction.

In the scanning step, as in the exemplary embodiment, the plurality of ejection adjustment patterns 61 formed on the print sheet 100 are scanned with the scanner 51 connected to the PC 50. The PC 50 obtains the thickness information of part of the thickness measurement pattern and the thickness information of part of the judging pattern 63 formed by each nozzle 31 in an associated manner, for each of the ejection adjustment patterns 61.

Figure 9:
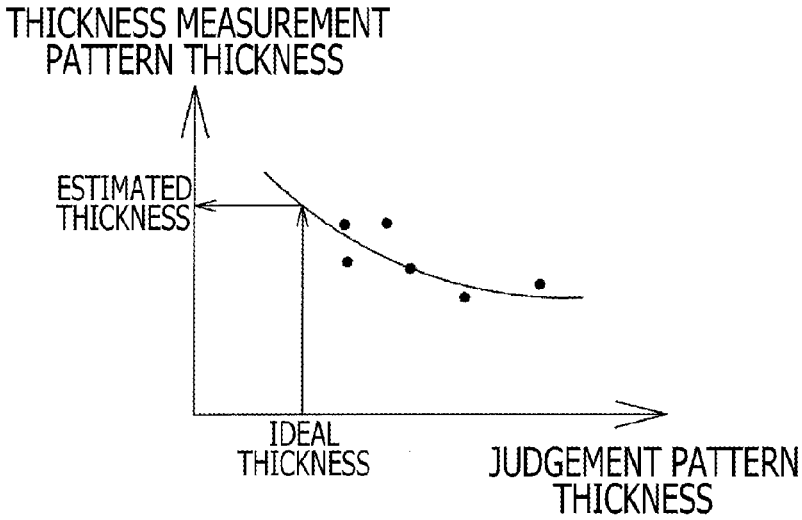
FIG. 9 shows co-relations between the thickness of the judgment pattern and the thickness measurement pattern according to the modified embodiment shown in FIG. 8.

Next, in the co-relation obtaining step, co-relation between the thickness of the plurality of judging patterns 63 and the plurality of corresponding thickness measurement patterns 62 for each nozzle 31 is obtained. An example of such a co-relation between the thickness of the judging pattern and the thickness of the thickness measurement pattern is shown in FIG. 9. For each nozzle 31, a plurality of pieces of thickness information are plotted in a graph of which a horizontal axis represents the thickness of the judgment pattern 63 and a vertical axis represents the thickness of the thickness measurement pattern 62. Then, with use of a least square method or the like to determine an interpolation equation and interpolate the graph. The co-relation as shown in FIG. 9 is obtained for each of the plurality of nozzles 31.

In a presumption step, with use of the co-relation between the thickness of the judging pattern 63 and the thickness of the thickness measurement pattern 62, the thickness of the thickness measuring pattern 62 which is presumed to be formed in the ideal condition in terms of the gap. If the thickness measurement pattern 62 is formed under the ideal condition in terms of the gap, the first judging pattern 63*a* and the second judging pattern 63*b* of the judging pattern 63 completely overlap. Therefore, the thickness (and therefore, the line thickness) can be presumed in advance. Therefore, as shown in FIG. 9, the thickness of the thickness measurement pattern 62 when the judgment pattern 63 is an ideal thickness is obtained, and the thus obtained thickness is presumed as the thickness under the ideal condition. The above presumption of the thickness is performed for each of the plurality of nozzles 31 using respective co-relations.

It is noted that, as in the exemplary embodiment, the co-relation obtaining step and the presumption step may be executed by the PC 50 connected to the scanner 51, or may be executed by the controlling device 40 of the printer 1.

Then, in the adjustment step shown in FIG. 9, for each of the plurality of nozzles 31, the ejection condition is adjusted using the thickness information of the thickness measurement pattern 62 presumed in the presumption step. According to this modification, the thickness information of the thickness measurement pattern 62 is presumed when the thickness measurement pattern 62 is formed under the ideal condition, with use of the thus presumed thickness information, a highly precise ejection adjustment can be achieved with almost perfectly excluding the effects of variation of the gap.

In the exemplary embodiment, the judging pattern 63 is formed such that the first judging pattern 63*a* and the second judging pattern 63*b* are completely overlap in the ideal condition in terms of the gap. In a modified embodiment, the first judging pattern 63*a* and the second judging pattern 63*b* may be spaced in the main scanning direction by a predetermined distance. In this case, at a pattern forming area where the gap is different from the ideal gap, the first judging pattern 63*a* and the second judging pattern 63*b* are displaced in the main scanning direction in accordance with the difference of the gap with respect to the ideal gap, and the a distance between the first judging pattern 63*a* and the second judging pattern 63*b* in the main scanning direction varies depending on the displaced amount. Therefore, by detecting the distance between the first judging pattern 63*a* and the second judging pattern 63*b* in each of the plurality of pattern forming areas 60, it becomes possible to judge the thickness measurement pattern 62 of which one of the pattern forming areas 60 is formed under the condition closest to the ideal condition in terms of the gap.

In the exemplary embodiment, one judging pattern 63 includes one line of first judging pattern 63*a* and one line of second judging pattern 63*b*. According to a modified embodiment, a plurality of lines of the first judging pattern 63*a* and a plurality of lines of the second judging pattern 63*b* are provided. For example, when one line of the first judging pattern 63*a* and one line of the second judging pattern 63*b* form a line which does not exhibit a line having a sufficient thickness and it is difficult to detect the positional relationship between the first and second judging patterns 63*a* and 63*b*, it is effective to provide a plurality of lines the first judging pattern 63*a* and a plurality of lines of the second judging pattern 63*b*.

If the printer 1 has a scanner function as in the exemplary embodiment, the ejection adjustment patterns 61 printed on the print sheet 100 may be scanned by the scanner unit 22 of the printer 1, and the information acquired by the scanner unit 22 may be processed by the controlling device 40 of the printer 1. In such a configuration, printing of the ejection adjustment patterns 61 on the print sheet 100, scanning of the ejection adjusting patterns 61 and adjustment of the ejection conditions of the plurality of nozzles 31 can be done with a single printer 1.

There is a technique to intentionally form a corrugated shape (i.e., alternately arranged ridge portions and valley portions) to the print sheet 100. In an example shown in FIG. 10, a plate 71 formed with a plurality of ribs 70*a* may be arranged below the print sheet 100 on an upstream side, in the feeding direction, of the platen 28 (see FIG. 2), and a plurality of nail portions 71 are arranged above the print sheet 100 such that the plurality of ribs 70*a* and the plurality of nail portions 71 are alternately arranged along the main scanning direction. Thus, the print sheet 100 placed on the plurality of ribs 70*a* are pushed by the nail portions 71 from the above. With this configuration, the print sheet 100 is formed to have a ridge portions at the ribs 70*a* and valley portions at the nail portions 71, which are arranged alternately in the main scanning direction and the print sheet 100 is formed to be the corrugated shape. If the print sheet 100 is deformed in such a manner, the gap between the inkjet head 26 and the print sheet 100 varies by a large amount in the main scanning direction. Therefore, in such a printer, it is effective to apply the present invention to identify the thickness measurement pattern 62 which is formed in a condition close to the ideal condition in terms of the gap.

Figure 10:
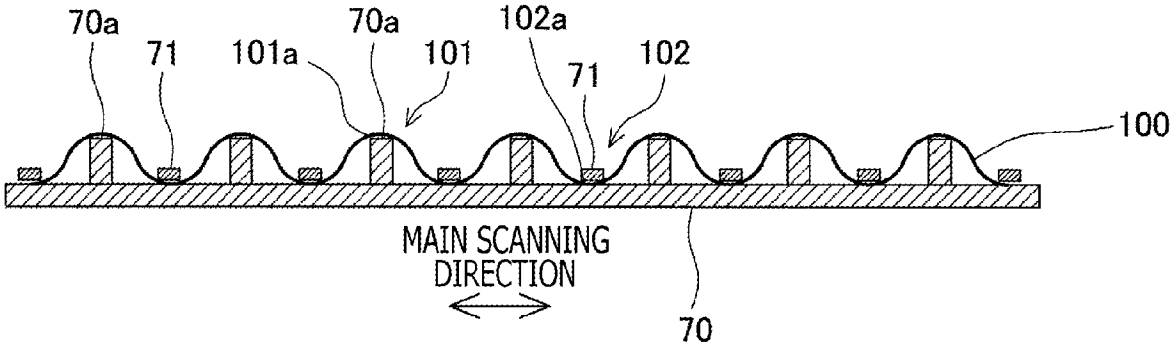
FIG. 10 shows a mechanism for forming a corrugated shape on the print sheet, according to another modification of the invention.

If the print sheet 100 is intentionally formed to have the corrugated shape as shown in FIG. 10, it is preferable to form the ejection adjustment pattern 61 at a portion between a peak 101*a* of the ridge portion 101 of the print sheet 100 at which the rib 70*a* contacts and a bottom 102*a* of the valley portion 102 of the print sheet 100 at which the nail portion 71 contacts. At the peak 101*a* of the ridge portion 101, the gap between the inkjet head 26 and the print sheet 100 has the minimum value, while the gap has the maximum value at the bottom portion 102*a* of the valley portion 102. Therefore, a portion where the gap has the ideal value is located at a position between the peak 101*a* and the bottom portion 102*a*. In other words, if the ejection adjustment pattern is formed between the peak 101*a* and the bottom portion 102*a*, the thickness measurement pattern 62 can be formed at a position where the gap has the ideal value.

The pattern forming areas 60 on which the ejection adjustment patterns 61 are formed need not be arranged in the main scanning direction and the feeding direction as shown in FIG. 6. For example, the pattern forming areas 60 may be arranged only in the main scanning direction. Alternatively, the pattern forming areas 60 may be arranged only in the feeding direction. Further alternatively, the pattern forming areas 60 may be arranged in the directions intersecting with both the main scanning direction and the feeding direction (e.g., in directions of diagonal lines of the print sheet 100).

The ejection adjustment patterns 61 need to be formed with the bi-directional printing, but may be formed with a one-directional printing. In other words, depending on whether the ejection adjustment is performed for the bi-directional printing or the one-directional printing, the thickness measurement patterns 62 may also be formed with the bi-directional printing or the one-directional printing.

In one modification, the thickness measurement patterns 62 may be formed with the one-directional printing. That is, when the inkjet head 26 is moved in one direction along the main scanning direction, by causing the plurality of nozzles 31 of one line 38 of nozzles eject the ink drops so as to be spotted thickly (i.e., without a space), a filled pattern having a plurality of dots which are evenly arranged can be formed.

When the thickness measurement pattern 62 is formed with one-direction printing, the first and second judging patterns 63*a* and 63*b* of the judging pattern 63 are also performed with the one-direction printing. In order to make the first judging pattern 63*a* and the second judging pattern 63*b* completely overlap each other with the one-direction printing, the ejection energy conditions for forming the first judging pattern 63*a* and the second judging pattern 63*b* are differentiated so that the ejection speed of the ink drops are differentiated. That is, two ink drops ejected from the same nozzle 31 at different timings can be spotted at the same position on the print sheet by differentiating the ejection speeds of the two ink drops.

An example of ejection adjustment pattern as described above will be shown. Firstly, during a first pass of the inkjet head 26, all the thickness measurement patterns 62 are formed (with the one-direction printing), and the first judging pattern 63*a* of the judging pattern 63 is formed. Next, during a second pass of the inkjet head 26 (of which the moving direction of the inkjet head 26 is the same since the one-direction printing is performed), the second judging pattern 63*b* is formed by differentiating the ejection condition (i.e., the ejection timing condition and the ejection energy condition) so that the second judging pattern 63*b* overlaps the first judging pattern 63*a*.

What is claimed is:

1. An ejection adjustment pattern forming method of forming an ejection adjustment pattern on a print medium with an inkjet head, which has a plurality of nozzles from which ink is ejected, with moving the inkjet head in a predetermined scanning direction, the method comprising:

forming a plurality of thickness measurement patterns respectively in a plurality of pattern forming areas defined on the print medium by causing the plurality of nozzles of the inkjet head to eject ink drops;

forming a dummy pattern in each of the pattern forming areas at a position adjacent, in the predetermined scanning direction, to the thickness measurement pattern;

forming a plurality of judging patterns respectively in the plurality of pattern forming areas defined on the print medium, the plurality of judging patterns being used to judge closeness of conditions in terms of a gap between the inkjet head and the print medium with respect to an ideal condition representing an ideal gap between the inkjet head and the print medium when each of the plurality of thickness measurement patterns is formed, wherein, in the step of forming the thickness measurement patterns, ejection conditions of the plurality of nozzles, when the plurality of thickness measurement patterns are formed, are the same among the plurality of pattern forming areas, wherein, the step of forming the judging patterns includes, forming a line-like first judging pattern in each of the plurality of pattern forming areas by causing the plurality of nozzles, which are used when the thickness measurement pattern is formed in the each of the plurality of pattern forming areas, to eject the ink, and forming a line-like second judging pattern, which is different from the first judging pattern, in each of the plurality of pattern forming areas by causing the plurality of nozzles, which are used when the thickness measurement pattern is formed in the each of the plurality of pattern forming areas, to eject the ink, and wherein the ejection conditions of the plurality of nozzles when the first judging pattern is formed and when the second judging pattern is formed are the same among the plurality of pattern forming areas.

2. The method according to claim 1, wherein the thickness measurement pattern is a filled pattern in which dots are evenly arranged when the thickness measurement pattern is formed with the gap being in the ideal condition.

3. The method according to claim 1, wherein the first judging pattern and the second judging pattern completely overlap when the judging pattern is formed under the ideal condition in terms of the gap.

4. The method according to claim 1, wherein two judging patterns are formed such that the two judging patterns sandwich one thickness measurement pattern in the predetermined scanning direction.

5. The method according to claim 1, wherein the plurality of pattern forming areas are arranged in the predetermined scanning direction.

6. The method according to claim 1, wherein the plurality of pattern forming areas are arranged in a feeding direction of the print medium, which direction intersects with the predetermined scanning direction.

7. A method of performing an ejection adjustment of each of a plurality of nozzles of an inkjet head, including an ejection adjustment pattern forming method of forming an ejection adjustment pattern on a print medium with an inkjet head, which has a plurality of nozzles from which ink is ejected, with moving the inkjet head in a predetermined scanning direction, the method comprising:

forming a plurality of thickness measurement patterns respectively on a plurality of pattern forming areas defined on the print medium by causing the plurality of nozzles of the inkjet head to eject ink drops;

forming a plurality of judging patterns respectively on the plurality of pattern forming areas defined on the print medium, the plurality of judging patterns being used to judge closeness of conditions in terms of a gap between the inkjet head and the print medium with respect to an ideal condition representing an ideal gap between the inkjet head and the print medium when each of the plurality of thickness measurement patterns is formed, wherein, in the step of forming the thickness measurement patterns, ejection conditions of the plurality of nozzles, when the plurality of thickness measurement patterns are formed, are the same among the plurality of pattern forming areas, wherein, in the step of forming the judging patterns, forming a line-like first judging pattern in each of the plurality of pattern forming areas by causing the plurality of nozzles, which are used when the thickness measurement pattern is formed in the each of the plurality of pattern forming areas, to eject the ink, and forming a line-like second judging pattern, which is different from the first judging pattern, in each of the plurality of pattern forming areas by causing the plurality of nozzles, which are used when the thickness measurement pattern is formed in the each of the plurality of pattern forming areas, to eject the ink, and wherein the ejection conditions of the plurality of nozzles when the first judging pattern is formed and when the second judging pattern is formed are the same among the plurality of pattern forming areas, the method further comprising:

scanning, for each of the plurality of pattern forming areas defined on the print medium, the thickness adjustment pattern and the judging pattern;

identifying one thickness measurement pattern, among the plurality of thickness measurement patterns, which is formed under a condition closest to the ideal condition based on information regarding shift amount between the first judging pattern and the second judging pattern in the predetermined scanning direction; and adjusting the ejection condition of the plurality of nozzles using thickness information of the thickness measurement pattern identified by the identifying step.

8. A method of performing an ejection adjustment of each of a plurality of nozzles of an inkjet head, including an ejection adjustment pattern forming method of forming an ejection adjustment pattern on a print medium with an inkjet head, which has a plurality of nozzles from which ink is ejected, with moving the inkjet head in a predetermined scanning direction, the method comprising:

forming a plurality of thickness measurement patterns respectively on a plurality of pattern forming areas defined on the print medium by causing the plurality of nozzles of the inkjet head to eject ink drops;

forming a dummy pattern in each of the pattern forming areas at a position adjacent, in the predetermined scanning direction, to the thickness measurement pattern;

forming a plurality of judging patterns respectively on the plurality of pattern forming areas defined on the print medium, the plurality of judging patterns being used to judge closeness of conditions in terms of a gap between the inkjet head and the print medium with respect to an ideal condition representing an ideal gap between the inkjet head and the print medium when each of the plurality of thickness measurement patterns is formed, wherein, in the step of forming the thickness measurement patterns, ejection conditions of the plurality of nozzles, when the plurality of thickness measurement patterns are formed, are the same among the plurality of pattern forming areas, wherein, in the step of forming the judging patterns, forming a line-like first judging pattern in each of the plurality of pattern forming areas by causing the plurality of nozzles, which are used when the thickness measurement pattern is formed in the each of the plurality of pattern forming areas, to eject the ink, and forming a line-like second judging pattern, which is different from the first judging pattern, in each of the plurality of pattern forming areas by causing the plurality of nozzles, which are used when the thickness measurement pattern is formed in the each of the plurality of pattern forming areas, to eject the ink, and wherein the ejection conditions of the plurality of nozzles when the first judging pattern is formed and when the second judging pattern is formed are the same among the plurality of pattern forming areas, the method further comprising:

scanning, for each of the plurality of pattern forming areas defined on the print medium, the thickness adjustment pattern and the judging pattern;

obtaining co-relation, based on information regarding shift amount between the first judging pattern and the second judging pattern in the predetermined scanning direction for each of the plurality of judging patterns, and thickness information of the plurality of thickness measurement patterns respectively corresponding to the plurality of judging patterns, between the information regarding the shift amount of the judging patterns and the thickness information, presuming the thickness information of the thickness measurement pattern which is formed under the ideal condition based on the co-relation between the information regarding the shift amount of the judging patterns and the thickness information obtained in the obtaining step, and adjusting the ejection condition of the plurality of nozzles using thickness information of the thickness measurement pattern presumed in the presuming step.

* * * * *